US005546678A

United States Patent [19]

Dhaemers

[11] Patent Number: 5,546,678

[45] Date of Patent: Aug. 20, 1996

[54] ARMOIRE ADAPTABLE TO A SAUNA, DRUM DRYER, AND TUBULAR LIGHTED CLOTHING DRYER WITH HUMIDITY DAMPER CONTROL OF EXHAUST GASES

[76] Inventor: Gregory L. Dhaemers, 829 N. 27th Ave. W., Duluth, Minn. 55806

[21] Appl. No.: 350,224

[22] Filed: Dec. 5, 1994

Related U.S. Application Data

[63] Continuation-in-part of Ser. No. 72,151, Jun. 4, 1993, Pat. No. 5,369,892.

[51] Int. Cl.[6] ..... F26B 19/00

[52] U.S. Cl. ..... 34/275; 34/60; 34/224; 34/74; 4/524

[58] Field of Search ..... 34/275, 224, 60, 34/74; 4/525, 524, 605

[56] References Cited

U.S. PATENT DOCUMENTS

| | | | |
|---|---|---|---|
| 1,755,013 | 4/1930 | McCormick | 34/163 |
| 2,221,351 | 11/1940 | Kempf . | |
| 2,232,022 | 2/1941 | Drake | 34/76 |
| 2,743,533 | 5/1956 | Smith | 34/75 |
| 3,256,616 | 6/1966 | McGoldrick | 34/210 |
| 3,362,081 | 1/1968 | Bogenberger . | |
| 3,513,564 | 4/1970 | Gramprie | 34/104 |
| 3,626,602 | 12/1971 | Glowacki | 34/72 |
| 3,670,425 | 6/1972 | Benjamin et al. | 34/72 |
| 3,739,487 | 6/1973 | Clark | 34/77 |
| 3,739,496 | 6/1973 | Buckley et al. | 312/271 |
| 3,805,561 | 4/1974 | Bullock | 68/12.12 |
| 3,837,088 | 9/1974 | Lenz | 34/29 |
| 3,858,331 | 1/1975 | Lord | 34/75 |
| 3,877,152 | 4/1975 | Gorman | 34/43 |
| 3,897,638 | 8/1975 | Lenz | 34/13 |
| 4,145,602 | 3/1979 | Lee | 219/370 |
| 4,180,919 | 1/1980 | Baltes | 34/86 |
| 4,471,537 | 9/1984 | Meda | 34/77 |
| 4,625,432 | 12/1986 | Baltes | 34/202 |
| 4,677,764 | 7/1987 | Cerny | 34/202 |
| 4,682,424 | 7/1987 | Irving | 34/202 |
| 4,846,145 | 7/1989 | Inouci | 4/524 |
| 4,869,872 | 9/1989 | Baltes | 34/77 |
| 5,127,169 | 7/1992 | Ellingson | 34/601 |
| 5,152,077 | 10/1992 | Liang | 34/219 |
| 5,369,982 | 12/1994 | Dhaemers | 34/275 |
| 5,416,931 | 5/1995 | Wolfenden et al. | 4/524 |

FOREIGN PATENT DOCUMENTS

| | | |
|---|---|---|
| 473567 | 8/1991 | European Pat. Off. . |
| 1562056 | 4/1969 | France . |
| 1816272 | 7/1970 | Germany . |

*Primary Examiner*—John M. Sollecito
*Assistant Examiner*—Steve Gravini
*Attorney, Agent, or Firm*—Burd, Bartz & Gutenkauf

[57] ABSTRACT

A dryer has an internal drying chamber for accommodating articles that are subjected to heated circulating air to remove moisture from the articles. An air mixing chamber contains a first fan for moving air through a heater into the drying chamber. A second fan draws air out of the drying and mixing chambers and discharges air back into the mixing chamber through a filter into the external environment. The heated air in the drying chamber is mixed with fresh air and recirculated through the drying chamber to minimize heat losses and increase drying effectiveness. Ultraviolet lamps within the drying chamber destroy contaminants in the air and articles within the chamber. A boot dryer, located in the drying chamber, has fans that move air through tubes used to support boots, shoes, skates and socks. Ultraviolet light in the boot chamber destroys contaminants in the air in the boot chamber. One modification of the dryer has a bench to permit the dryer to be used as a dry sauna. A further modification of the dryer has a rotatable tumbler for accommodating articles to be dried.

20 Claims, 12 Drawing Sheets

ARMOIRE ADAPTABLE TO A SAUNA, DRUM DRYER, AND TUBULAR LIGHTED CLOTHING DRYER WITH HUMIDITY DAMPER CONTROL OF EXHAUST GASES

CROSS REFERENCE TO RELATED APPLICATION

This application is a continuation-in-part of U.S. application Ser. No. 08/072,151, filed Jun. 4, 1993 now U.S. Pat. No. 5,369,892.

FIELD OF THE INVENTION

The invention is in the field of dryers for drying clothing, sporting and athletic equipment, dry saunas and tanning booths. The drying is achieved by circulating heated air in an enclosed chamber accommodating the articles to be dried.

BACKGROUND OF THE INVENTION

Wet outdoor garments, sport clothing and equipment have in the past been stored in garages, back rooms and basements where they would eventually dry due to natural air circulation. The natural air circulation is not conducive to rapid drying of articles. The damp articles, such as clothing, will mildew and have unpleasant odors when stored without adequate drying. Cloth drying machines having housings with drying chambers have been used for drying clothes. These machines have heating elements and fans for circulating hot air within the drying chambers to dry the clothes placed in the drying chambers. An example of this type of drying machine is shown by C. J. Liang in U.S. Pat. No. 5,152,077. The machine has a housing having a drying chamber for accommodating clothes. Heated air moving through the drying chamber carries moisture out of the drying chamber into a condensing compartment where moisture is condensed into water and then delivered to an evaporating apparatus and converted into steam. The steam is dried by an electric heater and moved back into the drying chamber. An ultraviolet light is located within the drying chamber for sterilizing the clothes in the drying chamber. Other machines having drying chambers for accommodating heated air for drying clothing are disclosed by A. Irving in U.S. Pat. No. 4,682,424 and J. W. McCormick in U.S. Pat. No. 1,755,013.

SUMMARY OF THE INVENTION

The invention is directed to a self-contained dryer having an internal chamber for accommodating articles, such as clothing, sporting equipment, hockey gear, shoes and other objects. The dryer has a housing enclosing a drying chamber in which the articles are dried and stored. Doors attached to the housing permit access to the interior of the chamber. Heated air is directed with a first fan into the drying chamber simultaneously with the discharge of air from the drying chamber with a second fan which draws fresh air into the drying chamber and selectively discharges air into an air mixing chamber and to the outside of the dryer. The heated air is recirculated in the drying chamber to increase its moisture content so that the dryer has effective, energy-efficient characteristics. Filters, such as charcoal filters, located adjacent air inlets and outlets, remove airborne odors and particulates from the air moving into and out of the dryer.

The dryer is equipped with a boot dryer, located within the drying chamber. The boot dryer has at least one additional fan that draws air from the drying chamber and discharges the air through tubular members extended into mittens, gloves or footwear, including boots and shoes. The additional fans also recirculate the air in the drying chamber. Ultraviolet lights located in the chamber are used to decontaminate the air. An infrared light is used to provide radiant heat in the drying chamber.

The dryer is adapted to accommodate damp and wet articles of clothing, hunting and sporting equipment including boots, shoes and socks and efficiently and effectively drying these articles. The dryer has a generally upright housing having an internal drying chamber for accommodating the articles to be dried. A pair of doors, hinged to the front of the housing, can be moved to open positions to permit access into the drying chamber so that the articles can be conveniently placed in the drying chamber. The doors are pivoted to their closed positions to enclose the drying chamber. The dryer can have a single door. The drying chamber has a generally horizontal ceiling, which forms with the top wall of the housing and air mixing chamber. Separate portions of the ceiling are provided with openings to allow air to flow from the air mixing chamber into the drying chamber and out of the drying chamber back into the air mixing chamber. An air heater, located in the air mixing chamber, is used to heat air that is supplied to the drying chamber. The heater can be an electric heating coil, an infrared lamp, a microwave heater or other devices used to heat air. A first fan operated with an electric motor is located in the air mixing chamber adjacent the heater. The fan operates to move air from the mixing chamber into the heater and hot air from the heater into the drying chamber. The air is directed downwardly into the drying chamber where it accumulates moisture from the articles located within the chamber. A second fan, located within the air mixing chamber, operates to draw air from the drying chamber and outside air into the drying chamber and discharge air into the mixing chamber or back to the environment outside of the dryer through filters containing charcoal or material to reduce odors from the air. A damper controlled by a humidistat in the drying chamber controls the flow of air discharged into the environment. The first and second fans operate concurrently to continuously circulate and recirculate the air in the drying chamber. The filters contain activated charcoal or materials which removes odors from the air flowing into and out of the dryer. Ultraviolet light fixtures mounted on the ceiling emit UV light that sterilizes the air and articles located within the drying chamber.

A casing, having an internal chamber, is located within the drying chamber to dry mittens, gloves and boot wear, including boots, shoes, skates, in-line roller blade-type skates, socks and the like. A plurality of tubular pipes or members are mounted on the casing and open to the internal chamber of the casing to deliver air into the articles mounted on the tubes. A pair of third fans mounted on the casing operate to move air from the drying chamber through the internal chamber of the casing and tubes to dry the articles thereon. A second ultraviolet lamp, located within the passages of the tubes, directs UV light through the tubes into the articles mounted thereon to destroy bacteria, fungus, mildew and other contaminants present in the air and article on the tube.

The heater and fans are controlled with a plurality of switches and a timer used to select the operating cycle of the dryer. A coin-operated mechanism can be used to control the timer. The control includes a switch connected to germicidal ultraviolet lights located within the drying chamber for sterilizing and decontaminating the air and articles within the drying chamber. All of the fans are under the control of a single switch so that the fans concurrently operate to move air into and out of the drying chamber, as well as to recirculate the air in the drying chamber. The air discharged from the dryer has a high moisture content resulting in high energy drying efficiency.

A first modification of the dryer includes a bench in the drying chamber to accommodate one or more persons. Infrared light in the drying chamber provides a heat source to heat the air and person in the drying chamber. The dryer is used as a dry sauna. When the ultraviolet lights are used, the dryer functions as a tanning booth. A moisture-producing system, such as a steamer or cool mist humidifier, can be used in the drying chamber to provide a wet sauna.

A second modification of the dryer includes a tumbler, such as an open rotatable drum, for accommodating articles located within the drying chamber. Rollers mounted on the housing support the tumbler for rotation about a generally horizontal axis. A motor releasably coupled to the tumbler rotates the tumbler. The tumbler can be removed from the drying chamber to permit the dryer to be used to dry articles located within the drying chamber. The tumbler has ribs with holes to accommodate hangers for supporting articles when the tumbler is not rotated. Articles, such as sports gear, can be stored and dried in the dryer. The chest is attached to wheels and a handle to facilitate manual handling of the dryer. The top of the drying chamber is closed with a cover hinged to the chest. The cover is movable to an open position to allow access to the drying chamber. Air porous walls within the drying chamber allow air to flow from the drying chamber back to the air mixing chamber for recirculation back into the drying chamber. The air also flows out of the drying chamber through a filter, such as an activated charcoal filter which removes odors from the air.

DESCRIPTION OF THE PREFERRED EMBODIMENTS

Figure 1:
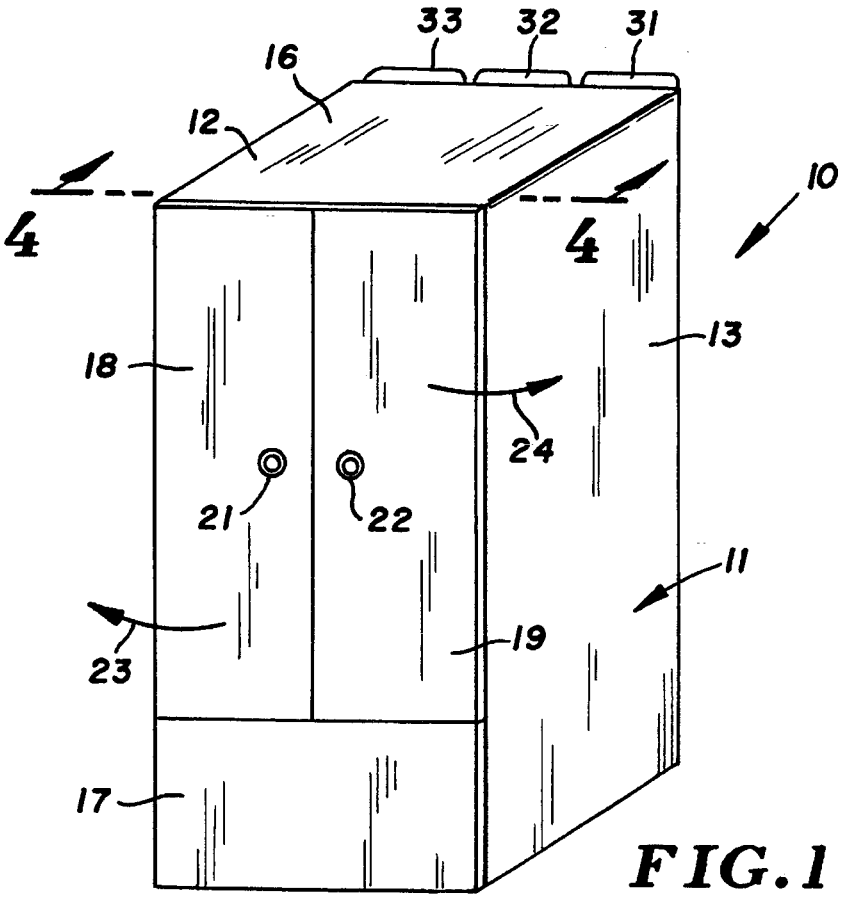
FIG. 1 is a perspective view of the dryer of the invention.
Figure 2:
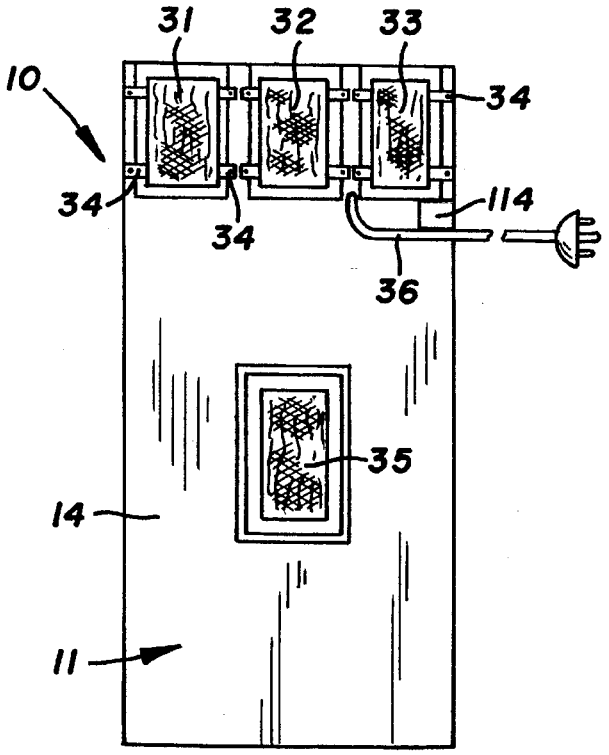
FIG. 2 is a rear elevational view thereof.

Referring to FIGS. 1 and 2, there is shown the armoire or dryer of the invention indicated generally at 10. Dryer 10 is a self-contained structure useable to dry articles and objects including, but not limited to, athletic equipment; such as hockey and baseball equipment, shoes, skates, in-line roller blade-type skates, hand and footwear, boots, socks, recreational and sports clothing and outdoor wear, sweaters, stockings and shirts that at times accumulate body perspiration or fluids, and become damp and wet in inclement weather or wet during laundry cleaning. The term "articles", as used herein, includes, but is not limited to, clothing, athletic equipment and outdoor wear and includes other products and objects that can be dried.

Figure 3:
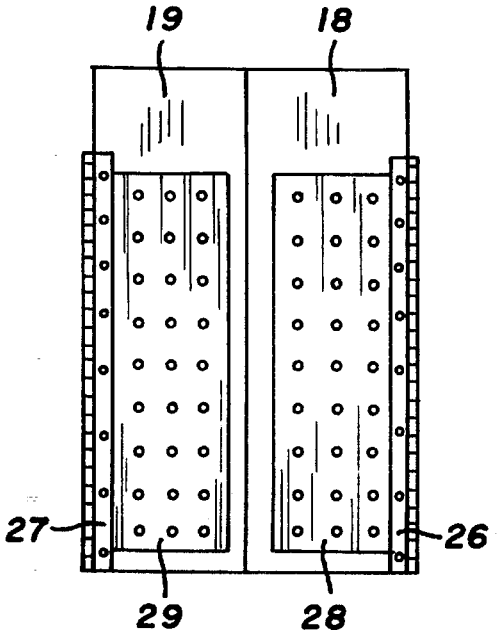
FIG. 3 is an elevational view of the inside of the doors of the dryer of FIG. 1.

Dryer 10 has a generally rectangular cabinet or housing 11, including upright side walls 12 and 13, joined to an upright back wall 14. A horizontal top wall 16 closes the top of the housing. The front of the housing has a lower front panel 17 located below a pair of doors 18 and 19. As seen in FIG. 3, hinges 26 and 27 pivotally mount doors 18 and 19 on side walls 12 and 13 so that the doors can be swung to open positions, as indicated by arrows 23 and 24 to provide full access to the interior of housing 11. Handles or knobs 21 and 22, attached to doors 18 and 19 respectively, are used as convenient hand grips to allow doors 18 and 19 to be opened and closed.

As seen in FIG. 3, peg boards 28 and 29 are secured to the inside surfaces of doors 18 and 19. Boards 28 and 29 can facilitate hooks and wire basket members for accommodating articles such as items of clothing and other objects to be dried. Other structures, such as walls with grooves, can be used to support articles within the drying chamber 41 of housing 11. For example, shelves can be used for flat drying of sweaters, shirts and other garments. A drying rack and hangers shown in U.S. Pat. No. 4,582,424 can be used to support articles in drying chamber 41.

Figure 5:
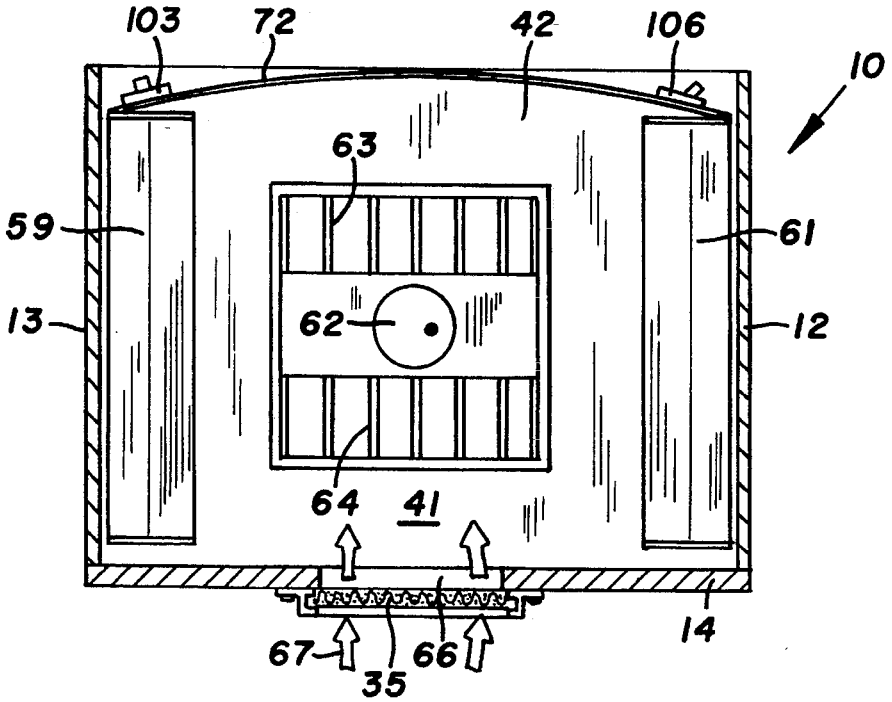
FIG. 5 is a sectional view taken along the line 5—5 of FIG. 4.

Referring to FIG. 2, the upper part of back wall 14 carries three filters 31, 32 and 33. The air filters are fiber and activated charcoal air filters that can be replaced. The charcoal air filters function to remove odors and particulates from air flowing out of the dryer. Other types of filters can be used to clean the air and remove odors from the air flowing into and out of the dryer. A plurality of clips or holders 34 attach filters 31, 32 and 33 to back wall 14. An electrical cord 36 extends through back wall 14 below filters 32 and 33. Cord 36 is connected to a ground fault circuit breaker 100, shown in FIG. 8. An air filter 35 mounted on back wall 14 covers an air inlet opening 66 to filter air flowing into drying chamber 41, as shown by arrows 67 in FIGS. 5 and 6. Filter 35 is a charcoal filter operable to remove odors and particulates for the air flowing into the dryer. The air flowing into the drying chamber is mixed with the air circulating in the chamber and makes up for the volume of air discharged through filters 31, 32 and 33.

Figure 7:
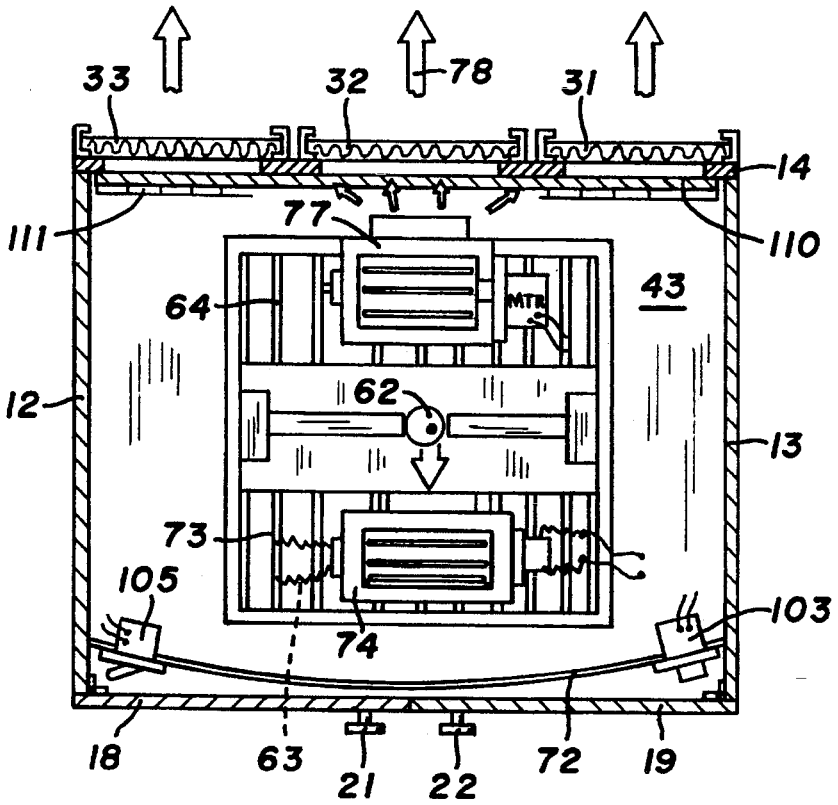
FIG. 7 is a sectional view taken along the line 7—7 of FIG. 4.

A damper or gate 110, located in chamber 43, adjacent filters 31, 32 and 33, controls the flow of air through the filters. Damper 110 is normally in the closed position, as shown in full lines in FIG. 6, closing the openings 109 in wall 14. The bottom of damper 110 is pivotally connected to wall 42 with a hinge 111. A humidity sensor or humidistat 112 having an air moisture sensing probe 113 located in chamber 41 is connected to reversible drive motor 114 operable to move to damper 110 between its open and closed positions. Humidistat 112 operates motor 114 to move damper 110 to an open position to allow air to be discharged through filters 31, 32 and 33, shown by arrow 78 in FIG. 7. Humidistat 112 operates in response to the moisture content of the air in drying chamber 41. When the moisture content of the air in drying chamber 41 is above a selected value, the humidistat 110 will operate motor 114 to open damper 110 thereby discharging air out of chamber 43 and allowing outside air to flow into drying chamber 41.

Figure 4:
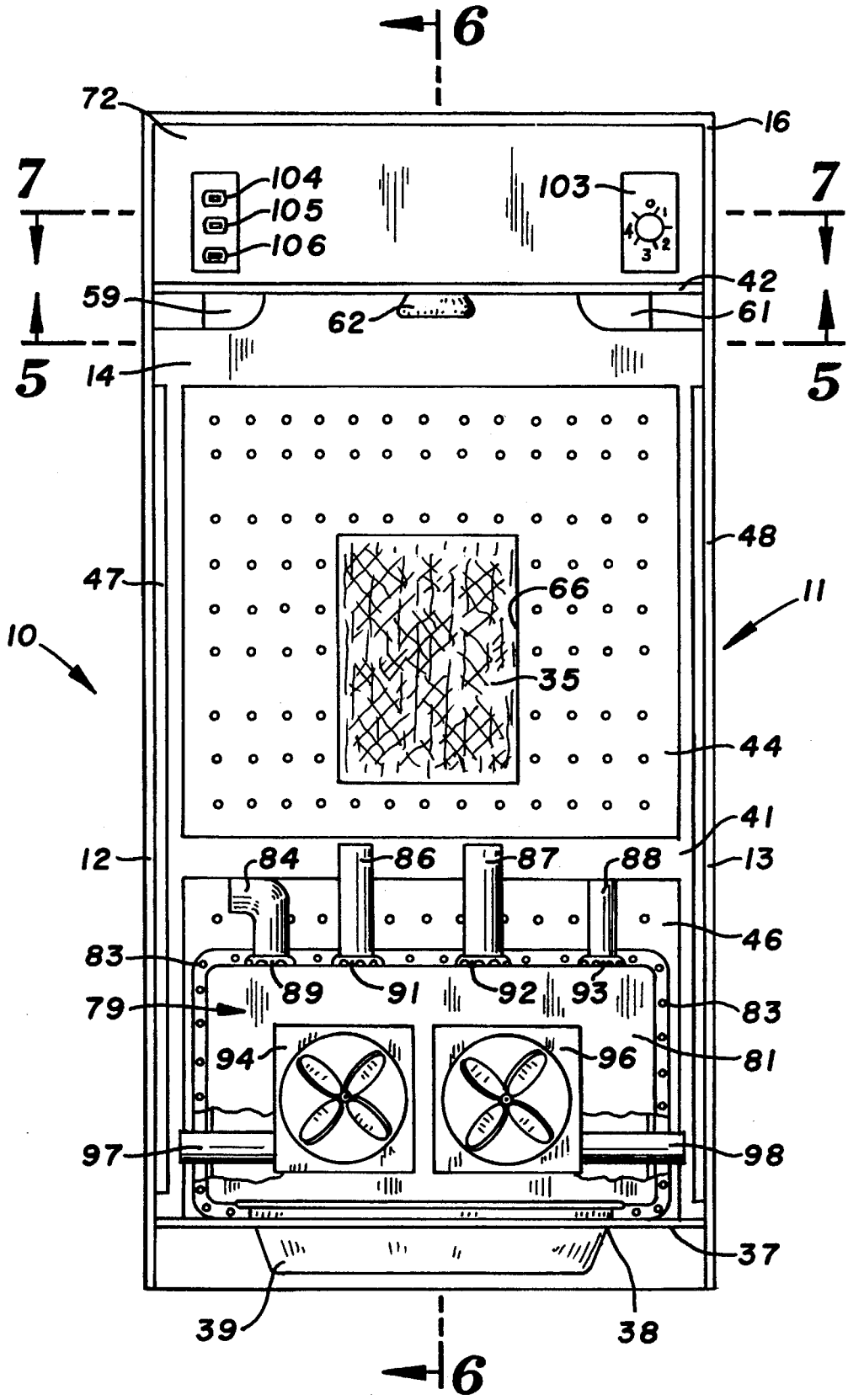
FIG. 4 is an enlarged front elevational view of the dryer taken along the line 4—4 of FIG. 1.
Figure 6:
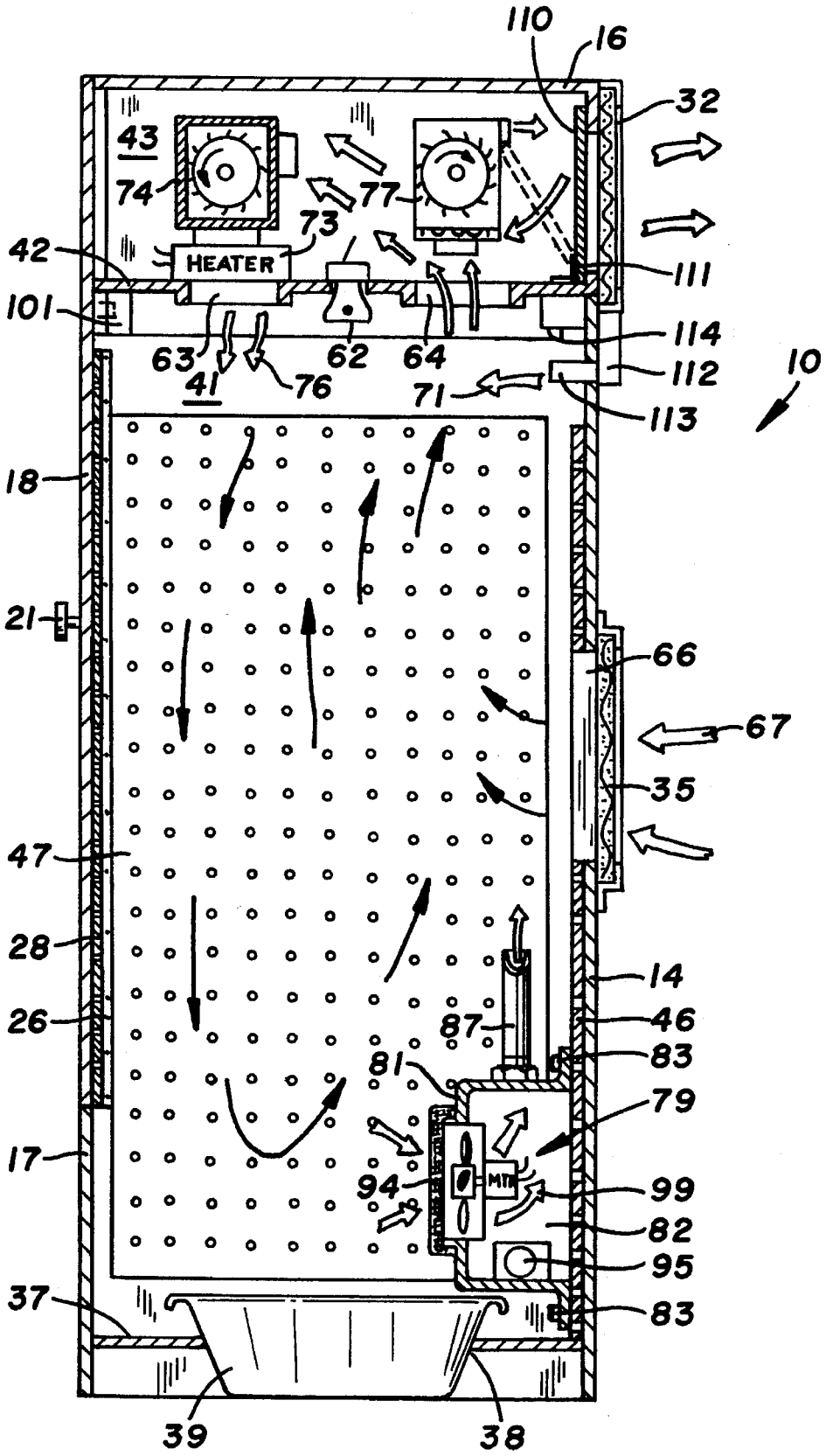
FIG. 6 is an enlarged sectional view taken along the line 6—6 of FIG. 4.

As seen in FIG. 4, a bottom wall or floor 37 is attached to lower portions of side walls 12 and 13 and back wall 14. Bottom wall 37 has a large central opening 38 accommodating a drip pan 39. Drip pan 39 has an open top to accommodate any water, ice or snow that is derived from the articles to be dried within housing 11. The articles are located within a drying chamber, indicated generally at 41, located above drip pan 39. The upper part of housing 11 has a ceiling or transverse wall 42 located below an air mixing chamber 43, as seen in FIG. 6.

The inside of back wall 14 accommodates a generally rectangular peg board 44 and a lower peg board 46. Boards 44 and 46 can be a single peg board. Peg boards 47 and 48 are secured to the insides of side walls 12 and 13. Article support structures or clips can be used to support shelves, hooks and other structures for supporting the articles within chamber 41. Rotatable cylinders can be placed in chamber 41 for holding articles as hereinafter described.

A pair of germicidal ultraviolet light fixtures 59 and 61 are located in the upper corners of drying chamber 41. Fixtures 59 and 61 are attached to opposite sides of the lower side of transverse wall 42. The ultraviolet light emitted from fixtures 59 and 61 functions to sterilize or decontaminate the air within chamber 41 and limit mold, fungus, virus, mildew, dry rot and bacterial growth on the articles to be dried.

The center of transverse wall 42 supports a light 62, such as an infrared light, and air grills 63 and 64, allowing air to circulate between drying chamber 41 and mixing chamber 43. The infrared light functions to heat the air, moisture and articles located in drying chamber 41. The heat aids in removing moisture from the articles. Back wall 14, as seen in FIGS. 4 and 6, has an opening 66 covered by filter 35 to allow outside air to flow into drying chamber 41. A motor-driven fan (not shown) can be mounted on back wall 14 to force additional outside air into drying chamber 41. Arrows 67 indicate the flow of air into chamber 41. Opening 66 allows outside air to flow into drying chamber 41 so that the dryer breathes when used for storage.

A front panel 72 closes the front portion of mixing chamber 43. Panel 72 supports a timer 103 and switches 104, 105 and 106 for controlling heater 73, ultraviolet lamps 59, 61 and 95, humidistat 112 and fans 74, 77, 94 and 96 used to circulate air in drying chamber 41 and air mixing chamber 43. A coin-operated mechanism (not shown) can be used to operate timer 103.

As seen in FIG. 6, a first fan or blower 74, having a squirrel-cage impeller driven with an electric motor, operates to deliver air through heater 73 and into drying chamber 41, as indicated by arrows 76. Heater 73 is shown as an electric resistance coil located between fan 74 and air grill 63. Other types of heaters including infrared light and electronic heaters can be used to heat air directed into drying chamber 41. A microwave-type heater can be used to heat the air and articles in heater 41. Fan 74 and heater 73 can be a single device mounted on interior wall 42. A second exhaust fan 77, having a squirrel-cage impeller driven with an electric motor, operates to draw air from drying chamber 41 and discharge the air toward charcoal air filters 31, 32 and 33 for discharge into the atmosphere, as indicated by arrows 78. A single electric motor can be used to drive fans 74 and 77. As shown in FIG. 6, outside air is drawn through air filter 35 to make up for the air that is discharged through air filters 31, 32, and 33 by the operation of fan 77. Fan 77 draws air from drying chamber 41 through air grill 64 and draws fresh, external air through air filter 35 and hole 66. This air is mixed with air from drying chamber 41 in chambers 41 and 43 and is discharged through heater 73 and air grill 63 into the top of drying chamber 41. The hot air from drying chamber 41 heats up the cool, fresh air thereby reducing the amount of heat energy required by heater 73 to heat the air being forced into drying chamber 41 by fan 74.

As seen in FIGS. 4 and 6, a second drying unit termed a boot dryer, indicated generally at 79, is located in the lower portion of drying chamber 41 adjacent back wall 14. Boot dryer 79 has a housing or casing 81 that is attached with fasteners 83, such as bolts, to back wall 14. Boot dryer 79 can be positioned at a selected elevation relative to back wall 14, as desired by the user of the dryer. Casing 81 has an internal chamber 82 that is open to a plurality of upright tubes 84, 86, 87 and 88. Sleeves with tightening nuts 89, 91, 92 and 93, secured to the top wall of casing 81, accommodate lower ends of tubes 84, 86, 87 and 88 so that the tubes can be removed and replaced with tubes having shapes that accommodate different types of mittens, gloves, boots, shoes, skates and the like. The sleeves associated with nuts 89, 91, 92 and 93 allow for vertical adjustment and circumferential positioning of tubes 84, 86, 87 and 88 to accommodate different types and sizes of articles. FIG. 4 shows tubes having different shapes and elevations that can be selectively attached to casing 81. An ultraviolet lamp 95 within casing 81 emits light to the casing and through tubes 84 and 86–88 to destroy contaminants in the air and articles located on the tubes. The front wall of casing 81 accommodates a pair of third and fourth fans or blowers 94 and 96 having blades rotated with electric motors to draw air from drying chamber 41 into boot dryer chamber 82 which is then forced through tubes 84, 86, 87 and 88 into the boots or like objects that are mounted on the tubes. Fans 94 and 96 also operate to discharge air laterally through tubes 97 and 98 into the lower portions of drying chamber 41, as indicated by arrows 99 in FIG. 6, to increase air circulation within the lower portion of drying chamber 41. A single fan can be used in lieu of fans 94 and 96. The direction of rotation of the fan blades associated with fans 94 and 96 can be reversed so that the air is drawn into tubes 84, 86, 87 and 88 and discharged into drying chamber 41.

Figure 8:
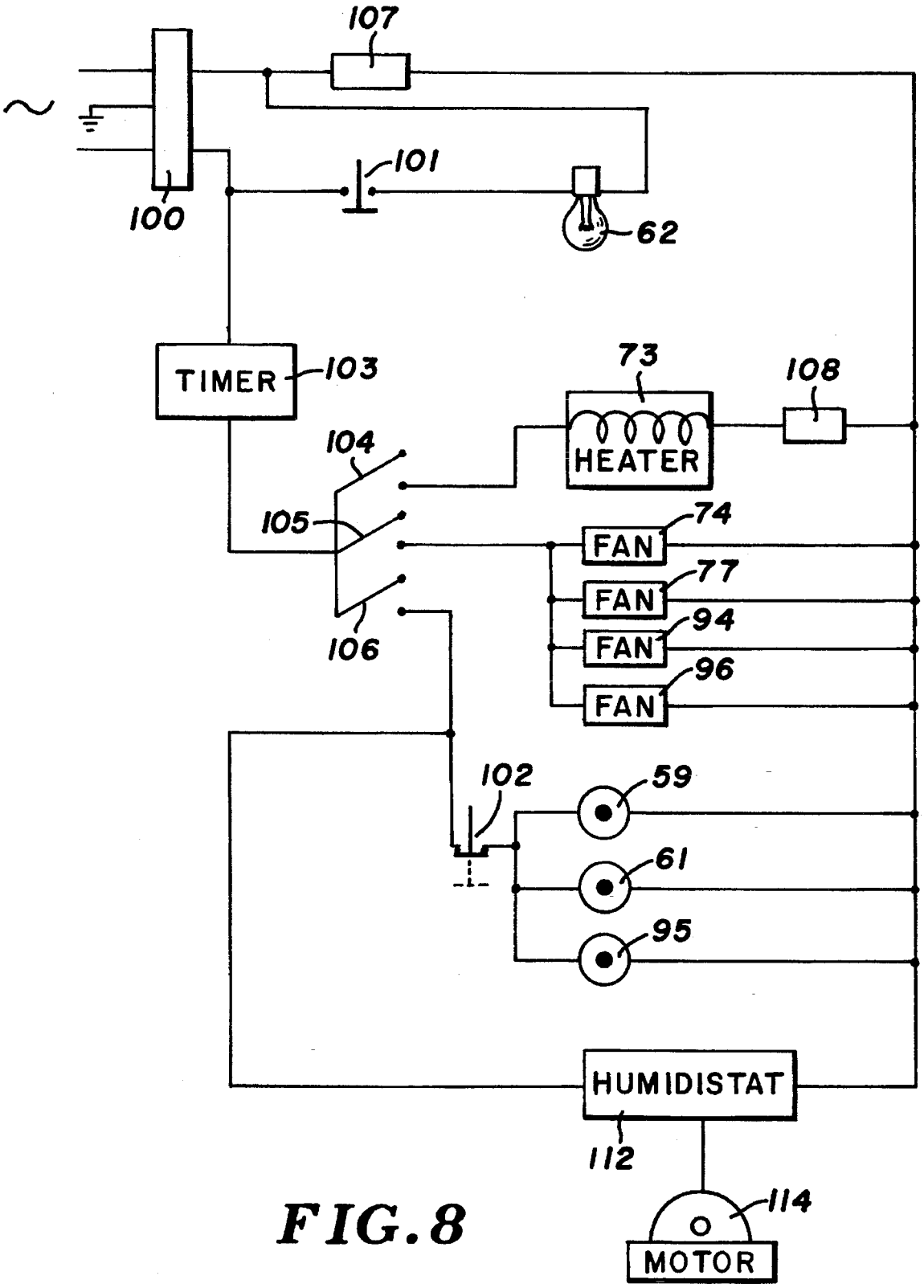
FIG. 8 is an electrical circuit diagram for the heater, fans and lights of the dryer of FIG. 1.

Referring to FIG. 8, there is shown the electrical circuit diagram for heater 73, fans 74, 77, 94 and 96, humidistat 110 and lights 59, 61 and 62 of dryer 10. A switch 101 functions to connect light 62 with the power source connected to ground fault circuit breaker 100. The operator of the dryer uses switch 101 to turn light 62 ON and OFF. Timer 103 is directly connected to three switches 104, 105 and 106. Switch 104 is operable to connect the power to heater 73. Switch 105 is operable to connect the power to all of the fans 74, 77, 94 and 96 so that the fans simultaneously operate to circulate and recirculate the air in the drying chamber and concurrently mix the air from the drying chamber with outside air in mixing chamber 43. Fans 94 and 96 also operate to move the air through the boot dryer as they draw air from the lower portion of the drying chamber.

Switch 106 is electrically connected to ultraviolet lights 59 and 61. A door-operated switch 102 is interposed in the line between switch 106 and lights 59 and 61. Switch 102 is normally closed when door 18 is closed. When door 18 is open, the switch is opened so that ultraviolet lights 59, 61 and 95 are OFF when door 18 is open.

The electrical circuit includes an adjustable humidistat 107 that senses the humidity of the air in drying chamber 41. When the humidity in the drying chamber 41 is below a selected limit, humidistat 107 will automatically open and thereby terminate the power to the timer and shut the entire system OFF. The electrical circuit also includes an adjustable thermostat 108 which is normally closed. When the temperature of the air within drying chamber 41 exceeds a pre-determined limit, thermostat 108 will open and thereby terminate the power to heater 73. The fans and ultraviolet lights remain ON. When the temperature in drying chamber 41 drops below a selected point, heater 73 is turned ON. Thermostat 108 is adjustable to change the upper and lower limits of the air temperature within drying chamber 41.

When switch 106 is closed, humidistat 110 is energized to sense the moisture content of the air in chamber 41 and controls the motor 114 and open and closed portions of damper 110. When the moisture content of the air in chamber 41 is below a selected value, the motor 114 holds the damped closed. The air in chambers 41 and 43 continues to circulate thereby pushing up additional moisture from the articles in chamber 41. The humidistat 110 controls motor 114 which opens damper 110 when the moisture content of the air in the chamber, as sensed by probe 113, is above or greater than a selected value. This allows air to be discharged from chamber 43 and permits fresh air to flow into chamber 41.

In use, doors 18 and 19 are moved to open positions to provide access to drying chamber 41. The articles, such as clothing, shoes and the like are placed within drying chamber 41 on suitable trays or hangers. The boots, shoes, skates and socks are placed over tubes 84, 86, 87 and 88 so that they can receive the air flowing through the tubes. Ultraviolet lights 59, 61 and 95 are OFF, as door-operated switch 102 is open or timer 103 is OFF. Light 62 is ON as door-operated switch 101 is closed when door 18 is open. Switches 104, 105 and 106 are turned to the ON position. Timer 103 is then set to a selected time, such as 30 minutes, to provide a definite drying duration. When switch 104 is closed, heater 73 operates to heat the air flowing through the heater. Switch 105, when closed, operates all of fans 74, 77, 94 and 96. Fan 74 drives the air from mixing chamber 43 through heater 73 and to the upper portion of drying chamber 41. Fan 77 draws air from drying chamber 41 and discharges the air through filters 31, 32 and 33 into the atmosphere. Part of the air drawn through air grill 64 flows into fan 74 and is recirculated in drying chamber 41. Outside air is drawn through filter 35, as seen in FIG. 6, and mixed with the air in drying chamber 41. The air in chamber 43 is moved by fan 77 through heater 77 into drying chamber 41. Fans 94 and 96 operate to move air from the lower portion of the drying chambers through the boot dryer into tubes 84–88 that accommodate the shoes, skates, boots and the like that are mounted thereon. The air flowing through the boots, skates, shoes and the like pick up moisture from the insides of these goods to facilitate the internal drying thereof. The UV light from ultraviolet lamp 95 destroys contaminants in the air and articles mounted on tubes 84–88. Fans 94 and 96 also recirculate air to the lower portion of drying chamber 41 through lateral tubes 97 and 98, as seen in FIG. 4. When switch 106 is closed, ultraviolet lights 59, 61 and 95 are ON. Subjecting the air and articles within the chamber and retained on tubes 84, 86, 87 and 88 to ultraviolet light has a decontamination effect thereon. When the humidity of the air in the drying chamber drops below a selected value, humidistat 107 will turn the system OFF. Thermostat 108 will turn heater 73 OFF when the temperature of the air exceeds a pre-determined value and turns heater 73 ON when the air temperature drops below a set point. Thus, the dryer will not over-dry the articles located in drying chamber 41 nor will the temperature of the air within the drying chamber exceed a selected value, as determined by the thermostat.

Figure 9:
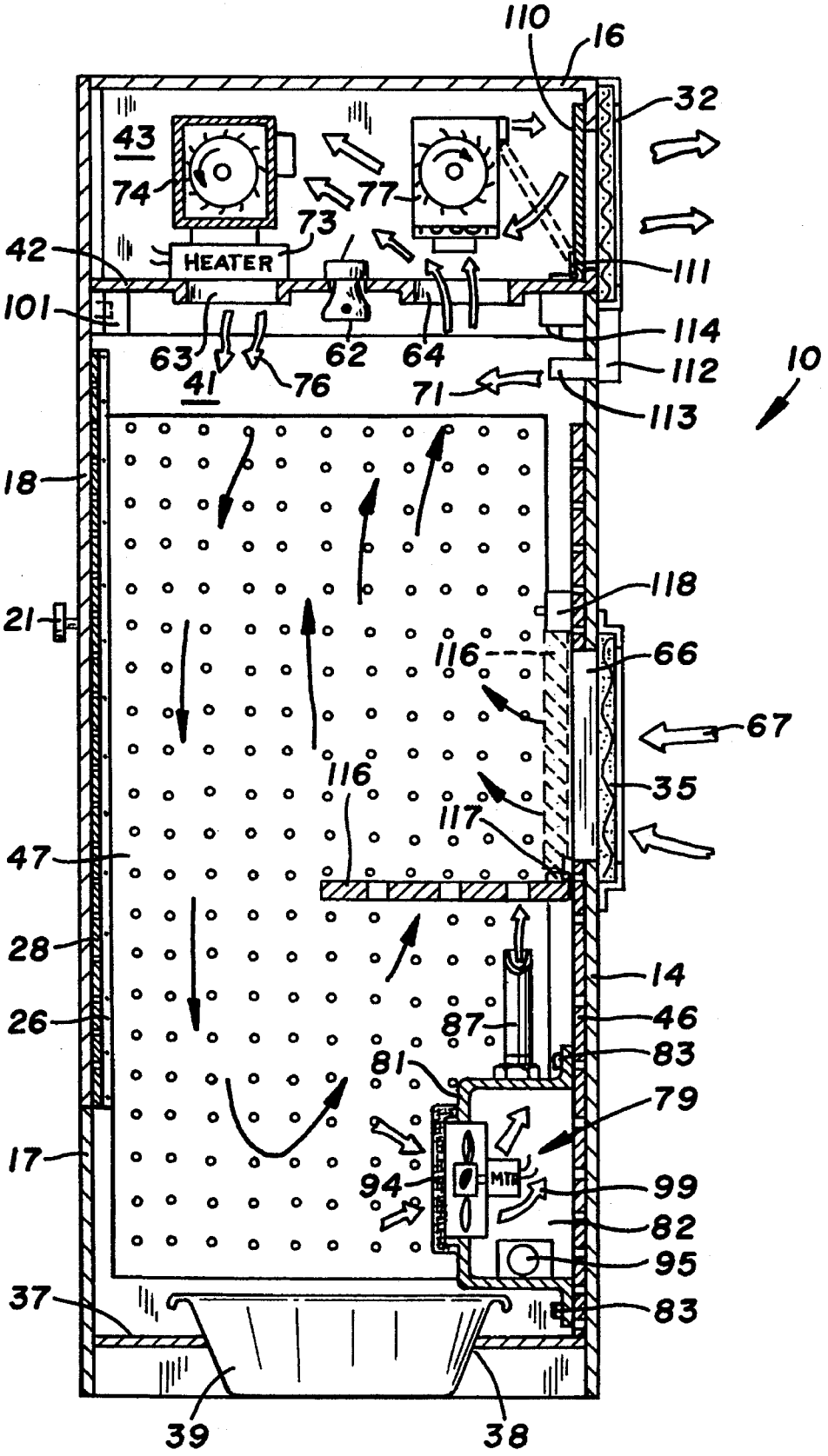
FIG. 9 is a sectional view similar to FIG. 6 of the dryer equipped with a bench.
Figure 10:
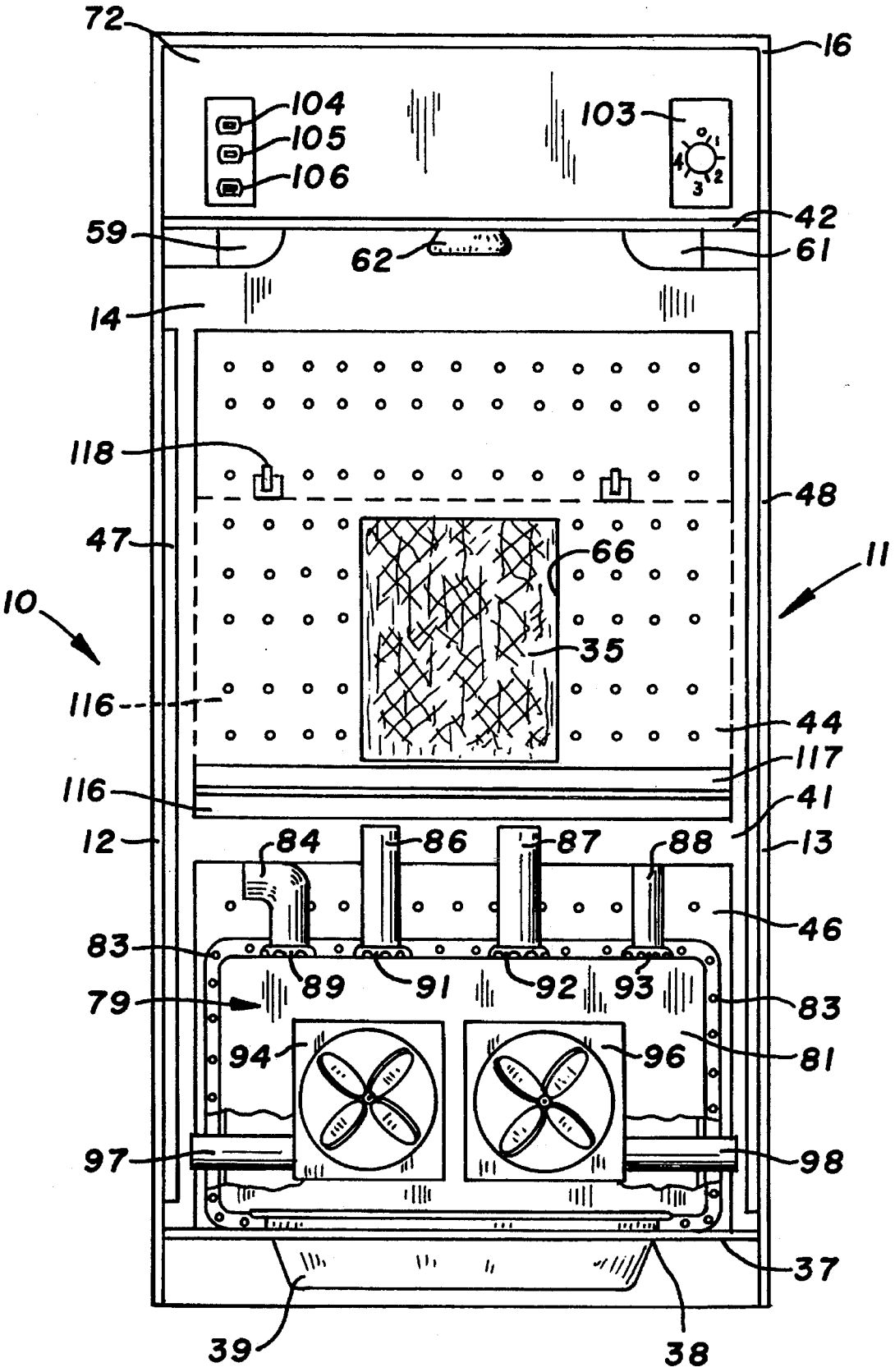
FIG. 10 is a front elevational view of the dryer of FIG. 9.

Referring to FIGS. 9 and 10, there is shown the dryer 10 equipped with a bench or seat 116. A transverse hinge 117 pivotally connects seat 116 to the upright wall 14 below filter 35. Seat 116 extends outwardly over boot dryer 79. Hinge 117 allows seat 116 to be pivoted upwardly to a generally vertical position, as shown in broken lines, to close the opening 66. A plurality of latches 118 functions to hold seat 116 in an upright position. Seat 116 is folded up against the back wall so that the dryer can be used as a drying systems. When seat 116 is in its generally horizontal position, dryer 10 can be used as a dry sauna, tanning booth or a product or clothes dryer. The ultraviolet lights 59 and 61 can be of the type used in tanning booths. The infrared light 62 generates radiant heat to the person within chamber 41. A humidity or moisture-producing unit can be included in chamber 41 to use dryer 10 as a wet sauna.

Figure 11:
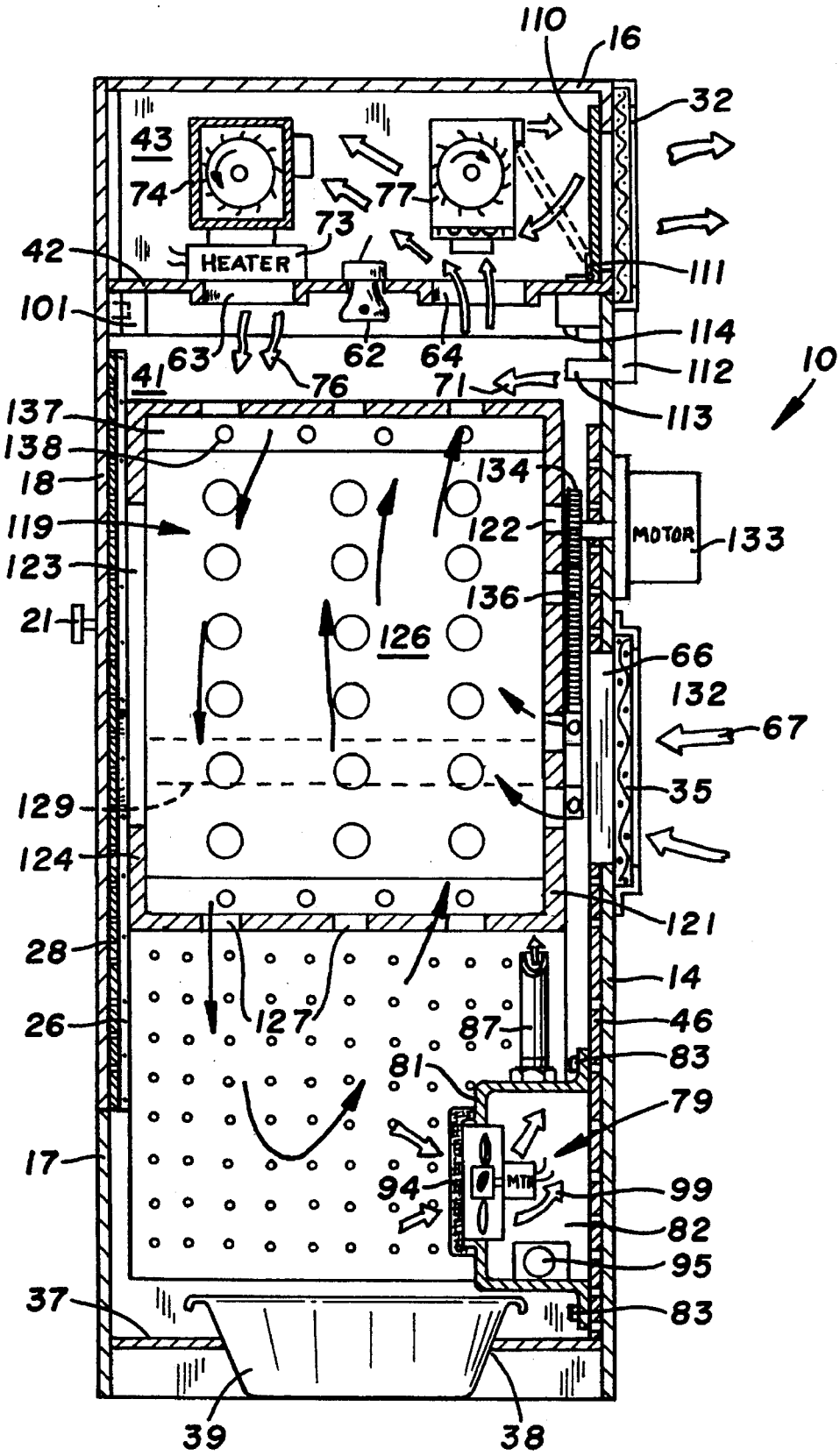
FIG. 11 is a front elevational view similar to FIG. 6 of the dryer equipped with a rotatable tumbler.
Figure 12:
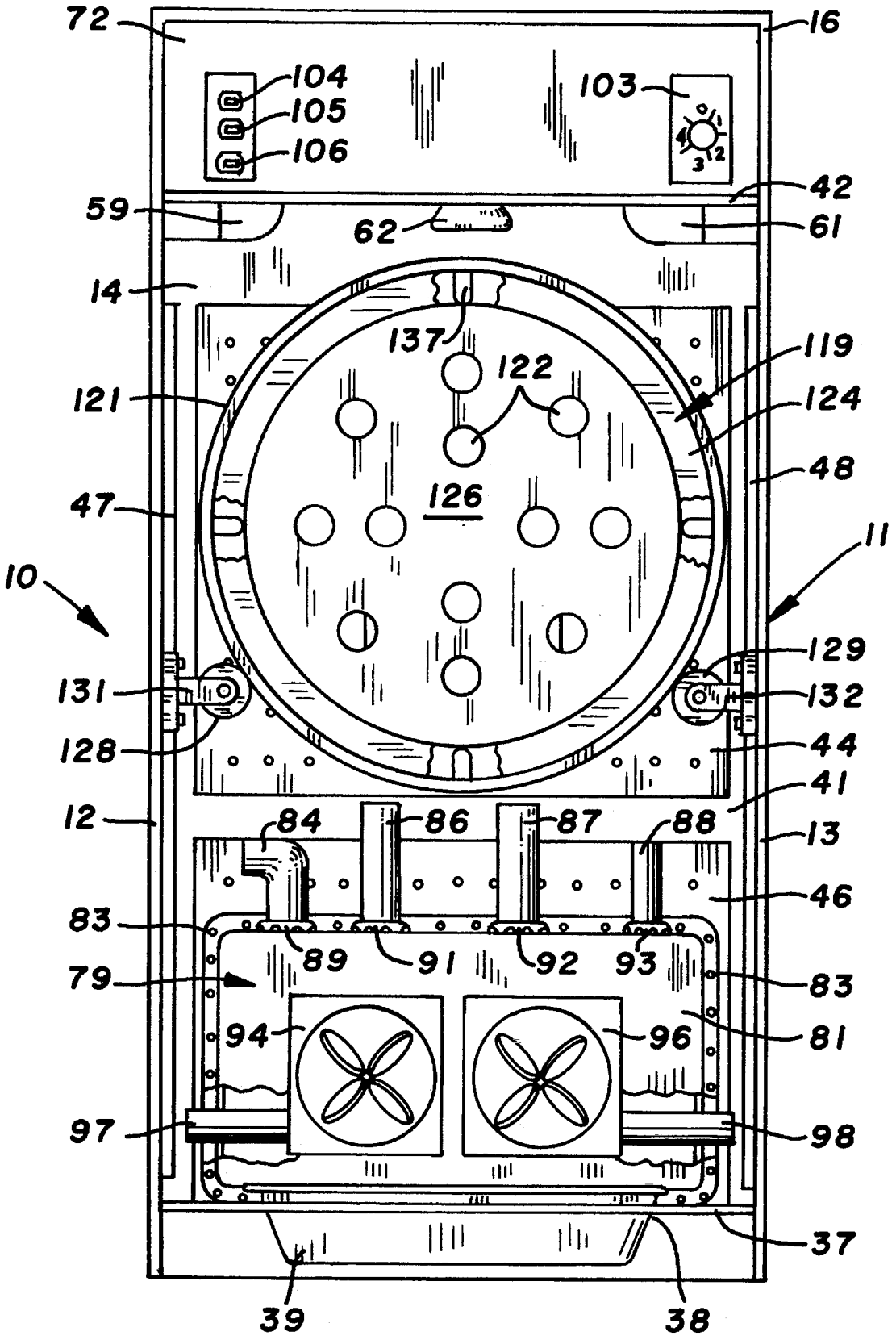
FIG. 12 is a front elevational view of the dryer of FIG. 11.

Referring to FIGS. 11 and 12, there is shown the dryer 10 equipped with a tumbler, indicated generally at 119, for accommodating articles, such as wet clothes, to be dried. Tumbler 119 is located in chamber 41. Tumbler 119 has a cylindrical cage 121 having a plurality of holes 127 that allow air to flow into and out of a chamber 126. The rear end of cage 121 is attached to a generally circular end wall 122 having a plurality of holes facing the filter 35. The front end of cage 121 has a large circular opening 123 that is formed by a cylindrical or annular flange 124. Cage 121 is rotatably supported in chamber 41 with a plurality of horizontal rollers or roll bars 128 and 129. Brackets 131 and 132 rotatably hold rollers 128 and 129 on the side walls 14 and 17. Rollers 128 and 129 allow the cage 121 to be removed through the open door of the dryer.

A motor 132, having a drive gear 134, is located in driving engagement with an gear 136 secured to cage 121. Motor 133 operates to rotate cage 121 about a generally horizontal axis. Cage 121 can be rotated with a motor located below the cage and a belt drive. Other types of drive systems can be used to rotate tumbler 121.

As seen in FIGS. 11 and 12, cage 121 has a plurality of longitudinal ribs 137 having a plurality of holes 138. Hangers or other support structures can be mounted on the ribs 137 to dry articles located on the hangers. Cage 121 is not rotated during the drying of articles located on hangers attached to the ribs 137. The heater 73 heats the air that is discharged from the blower 74 into the drying chamber 41. The air flows through the chamber 126 of the cage 121 and is withdrawn from cage 121 and chamber 41 with blower 77. Make up air flows through filter 35 into chamber 41 when damper 110 is open.

Cage 121 is rotated about a horizontal axis that extends from the front to the rear of chamber 41. An alternative cage structure can be located for rotation about a horizontal axis between the side walls of the dryer.

Figure 13:
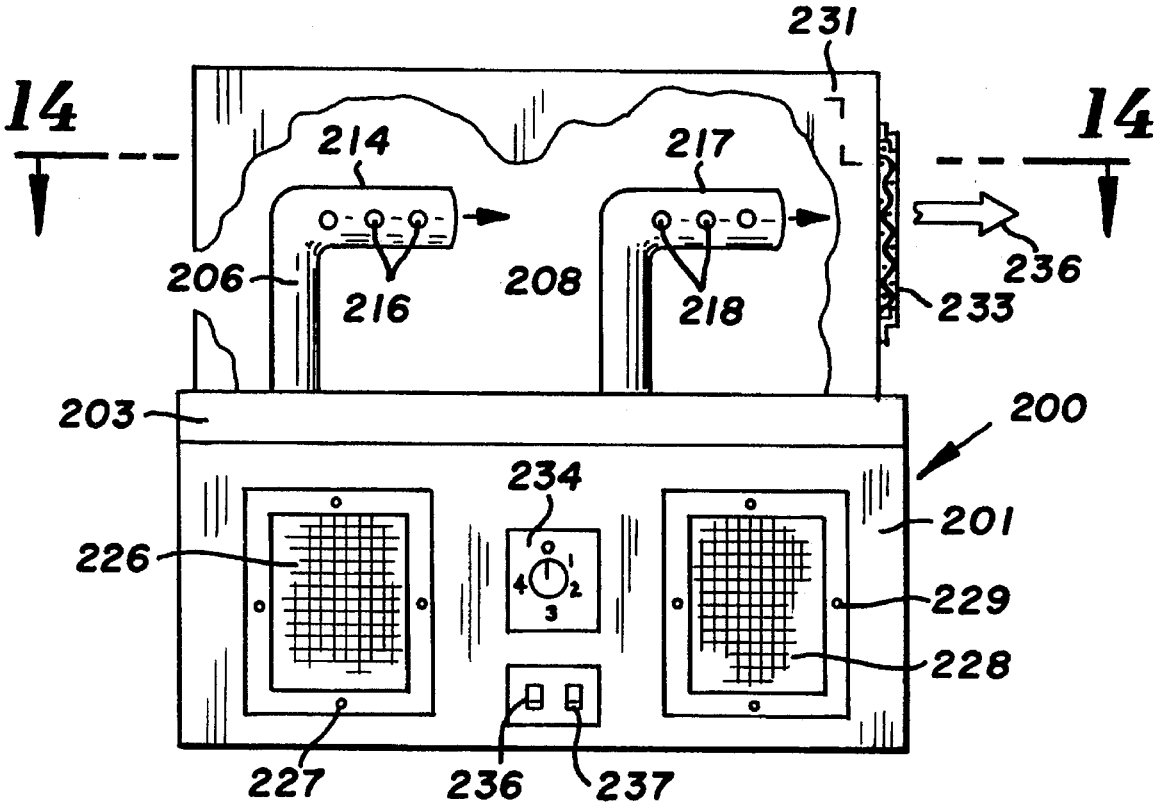
FIG. 13 is a front elevational view, partly broken away, of a modification of the boot dryer usable with the dryer of FIG. 1.
Figure 14:
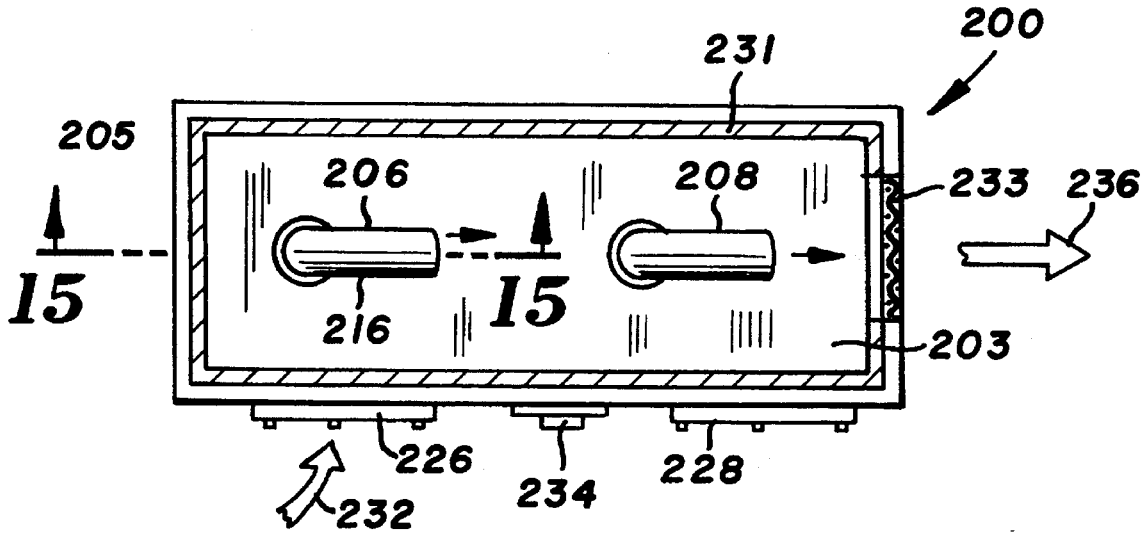
FIG. 14 is a sectional view taken along the line 14—14 of FIG. 13.
Figure 15:
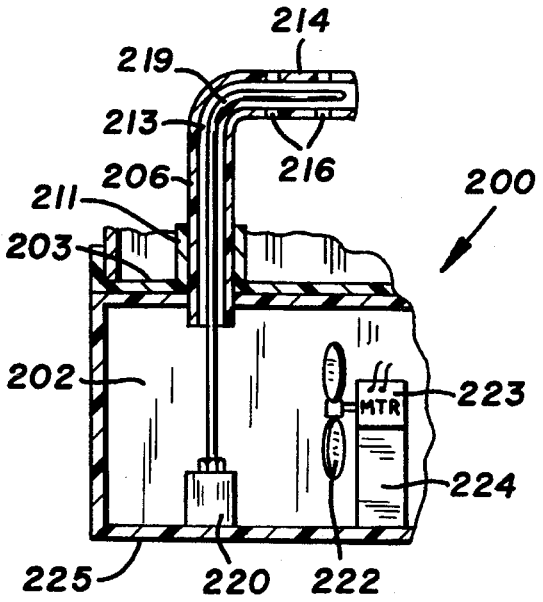
FIG. 15 is a sectional view taken along the line 15—15 of FIG. 14.

Referring to FIGS. 13–15, there is shown a modification of the boot dryer, indicated generally at 200, usable with dryer 11 or independently of the dryer. Boot dryer 200 can replace boot dryer 79 located within drying chamber 41. Dryer 200 is used to remove moisture and odors from shoes, skates, boots, in-line roller blade-type skates, socks, gloves, mittens and other hand and foot wear.

Dryer 200 has a generally rectangular casing 201 enclosing an internal chamber 202. A drip pan or tray 203 is located on top of casing 201 to collect any water, snow, ice, mud or the like that may fall from the articles being dried. Tray 201 is generally pan-shaped with four laterally located upright bosses 204 and a peripheral outer upright side wall 205. Upright tubes 206 and 208 extend through tubular bosses 204 down into chamber 202. As seen in FIG. 14, split clamp collar 211, located about tube 206, is retained thereon with bolt 212. The collar allows tube 206 to be vertically adjusted. Tube 206 can also be circumferentially located to accommodate different types and styles of articles to be placed thereon. Other types of holding structures can be used to retain tube 206 on casing 201. Tube 206 has an upright continuous passage 213 to allow air to flow through tube 206. The upper end 214 of tube 206 extends laterally to fit into a boot or shoe to direct air into the interior of the shoe. End 214 has a number of holes 216 to direct air toward the sides of the interior of the boot or shoe. Tube 208 has a lateral end 217 with holes 218 to distribute air in another boot, shoe or socks. Each tube 206 and 208 has an open outer end for directing air to the interior of the article located over the tube.

Returning to FIGS. 13 and 14, the tubes 208 and 208 are covered with a hood or housing 231 resting on tray 203. One or more air filters 233 mounted on hood 231 allow air to flow from the inside of hood 231 to the external environment, as shown by arrow 236. Filters 233 can include activated carbon or like materials to remove odors from the air flowing through the filters.

As seen in FIG. 15, an ultraviolet lamp 219, located within chamber 202 and mounted on a fixture 220, is axially aligned with passage 213 and extends up into passage 213 and end 214. Lamp 219 emits ultraviolet light into passage 213. Tube 205 is made of material that allows the ultraviolet light to pass to the interior of the article mounted on tube 206. Thus, the ultraviolet light is directed to the body, toe and heel sections of the boot, socks or the like that are placed on tube 206. The ultraviolet light has a germicidal and disinfectant effect on contaminants including bacteria, spores, fungus, viruses and the like that may be present in the article located on tube 206 and the air flowing therethrough. Tube 208 has the same structure as tube 206. Dryer 200 can have one or more tubes having shapes to accommodate the articles to be mounted thereon.

Air is drawn into chamber 202 with fan 222, operated with electric motor 223. Support or stand 224 locates fan 222 in alignment with an opening in casing 201 covered with filter 226, such as an activated charcoal filter. A plurality of fasteners 227, as seen in FIG. 13, secures filter 226 to casing 201. A second filter, such as an activated carbon filter 228, is located on casing 201 and attached thereto with fasteners 229. Filter 228 covers an opening in casing 201 open to chamber 202. A second fan driven by a motor (not shown) is located behind filter 228 to move air through filter 228. An example of this fan and motor is fan 222 and motor 223, as shown in FIG. 15. Other types of structures, such as blowers, impellers and the like, driven by motors, can be used to move air through filters 226 and 228.

Returning to FIG. 13, timer 234 is mounted on the center portion of casing 201 between filters 226 and 228. Timer 234 is used to set the interval of time on the operation of the fan 222 that move the air into tubes 206 and 208. Fan 222 can be used to draw air into tubes 206 and 208. The incoming air flows into the articles, such as a boot, shoe or the like to be dried and through hood 231 and filter 233 into the external environment. The external air indicated by arrow 232 can be heated with a heating coil (not shown) located within chamber 202. Other types of heating structures can be used to heat the air used to dry articles mounted on the tubes. A heater can be located within chamber 202 adjacent fan 222 and move air into tubes 206 and 208 and through articles mounted thereon. This air picks up the moisture, as well as the odors from the article that is being dried. The air moving through filters 226 and 228, which contain odors, removes the odors from the air. The motor 223 for the fan is connected to an electrical power source via switches 236 and 237. Switches 236 and 237 can be simultaneously turned ON or individually turned ON to control the flow of air through tubes 206 and 208 into and out of chamber 202 and through filters 226, 228 and 233.

When dryer 200 is used with dryer 11, motors 223 for fan 222, can be directly connected to switch 105 so that the exhaust and recirculating fans 74 and 77 operate concurrently with boot dryer motors 223.

Figure 16:
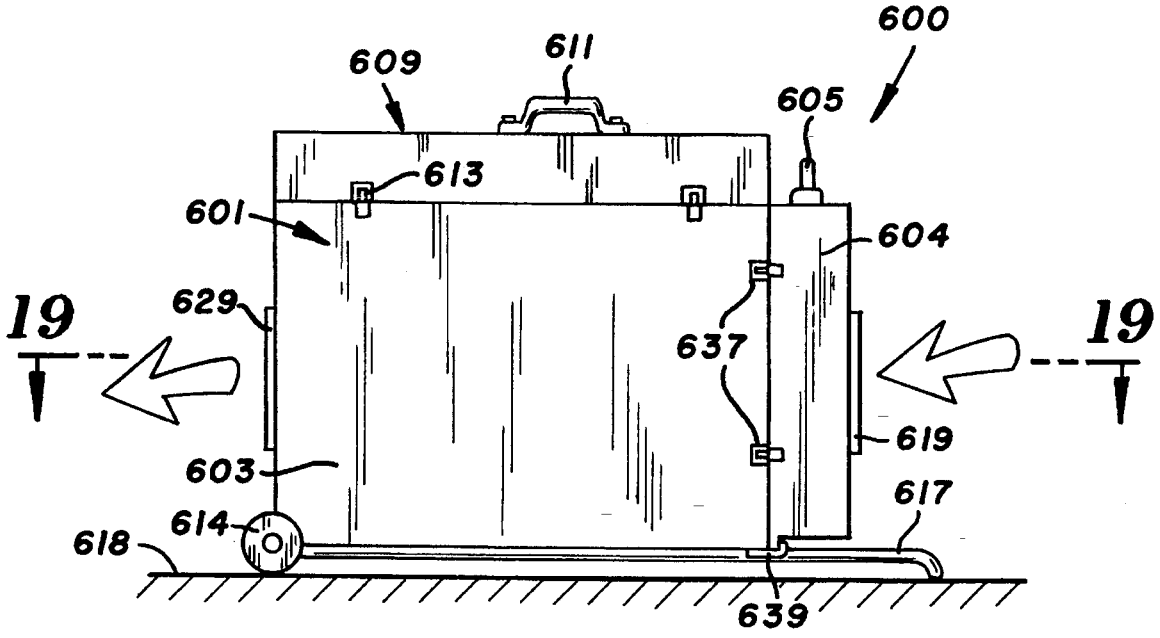
FIG. 16 is a side elevational view of another modification of the dryer of the invention.
Figure 17:
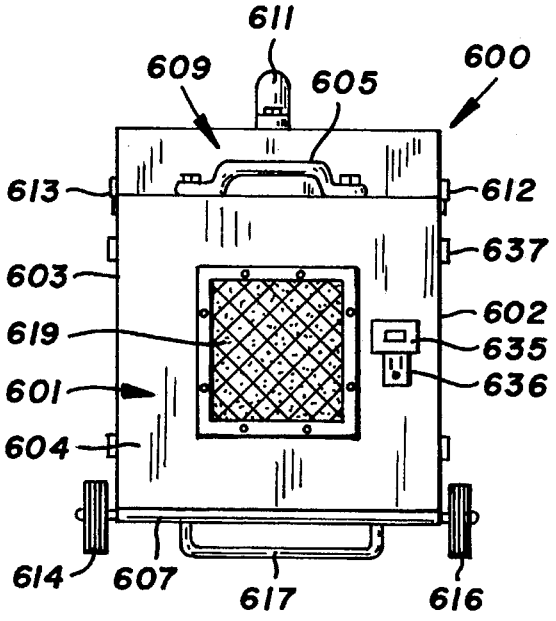
FIG. 17 is a front elevational view of FIG. 16.
Figure 18:
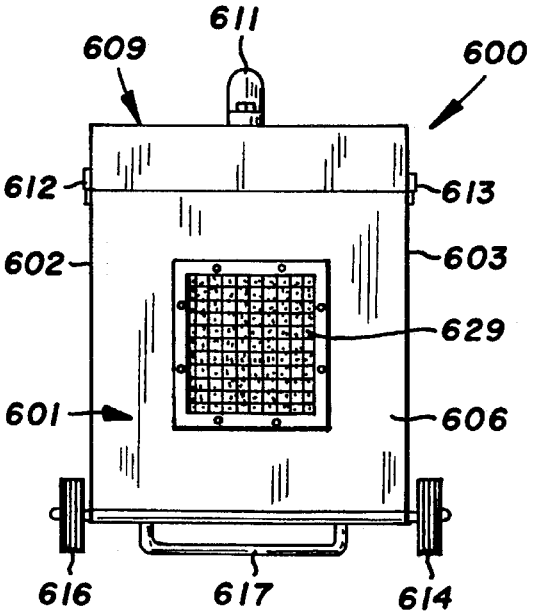
FIG. 18 is a rear elevational view of FIG. 16.
Figure 19:
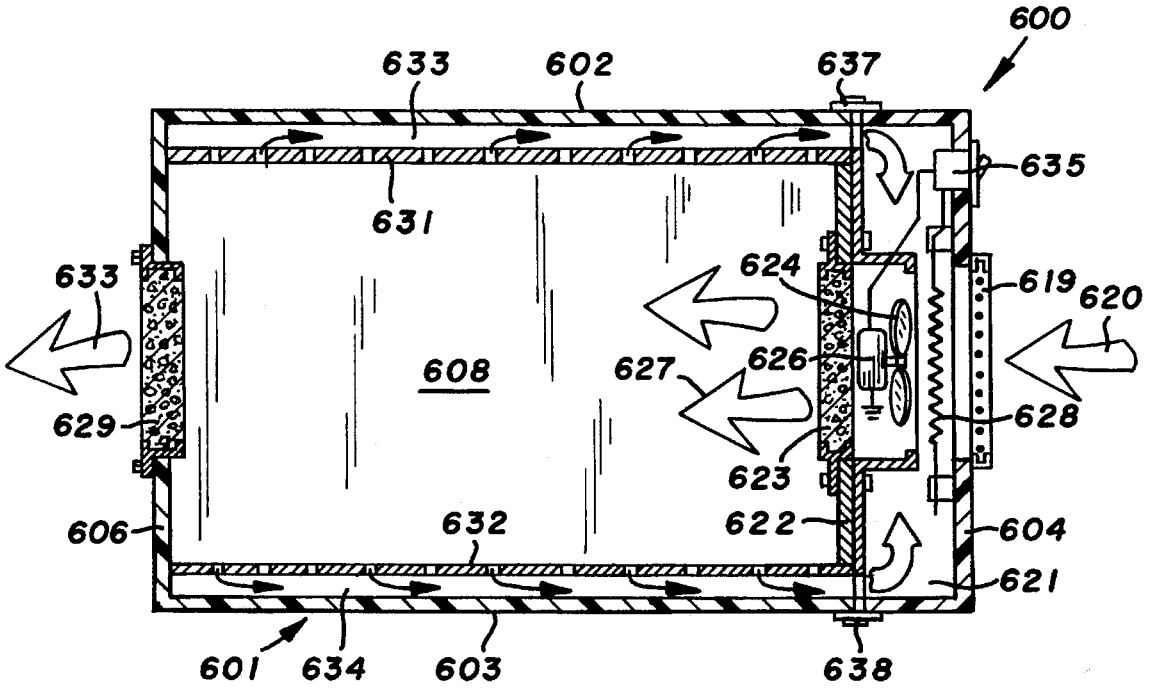
FIG. 19 is an enlarged sectional view taken along the line 19—19 of FIG. 16.

Referring to FIGS. 16–19, there is shown a modification of the dryer of the invention, indicated generally at 600. Dryer 600 is a movable and portable structure usable to dry and store articles, such as clothing, athletic equipment and recreational products. Dryer 600 has a box-shaped housing or chest, indicated generally at 601, comprising upright side walls 602 and 602 joined to an air inlet housing 604. The air flows out of the chest through an air outlet end wall 606. A generally flat bottom wall 607 closes the bottom of the chest 601 and provides the bottom for a drying chamber 608, as seen in FIG. 17. The walls of chest 601 are rigid structures made of wood, plastic and paper material. Flexible plastic, fabrics or canvas can be used for chest 601. The top of drying chamber 608 is closed with a top member or cover, indicated generally at 609. A handle 611, attached to cover 609, is used to open the cover and/or transport the dryer. Other handles and straps can be used to conveniently carry the dryer. Hinges 612 pivotally connect cover 609 to side wall 602. The opposite side of cover 609 accommodates latches 613 that secure cover 609 to side wall 603. Casing 601 has a front end wall 622 that supports a filter 623. Filter 623 is a charcoal filter that filters the air moving into the drying chamber, as indicated by the arrows 627. The outer wall 606 has a charcoal filter 629 that filters the air flowing from the drying chamber into the atmosphere, as indicated by the arrows 633.

Housing 604 is removably mounted on the front end of casing 601 so that it can be detached from the casing. This allows the casing to be independently transported. Located within housing 604 is a fan 624 driven by an electric motor 626. A heater 628, located in front of fan 624, heats the air moving through the grill 619 mounted on the front wall of housing 604. Fan 624 is a blade-type fan or an impeller fan that is operable to provide a continuous supply of air to drying chamber 608. Other types of air moving structures, such as a cylindrical blower, can be used to move the air through the filter 623 into the drying chamber 608. A switch 634, mounted on the front wall of housing 608, is used to control a supply of electric power to the motor 626. As seen in FIG. 14, an electric plug receptacle 636 is mounted on housing 604 below switch 634. The controls for motor 626 and heater 628 can include a timer and thermostat (not shown), as disclosed by timer 103 and thermostat 108, as shown in FIG. 8.

Latches 637 releasably attach housing 604 to the side walls of chest 601. As seen in FIG. 16, chest 601 has an upwardly-directed lip 638 that accommodates a bottom portion of housing 104. A handle 605, attached to the top of housing 104, is used to carry the housing.

Chest 106 and housing 104 are mounted on a movable carriage comprising a pair of wheels 614 and 616 rotatably mounted on the lower end of housing 601. An elongated handle 617, attached to the bottom wall 607 of chest 601, serves as a hand grip to facilitate the moving of dryer 600 on the floor surface 618. Handle 617 can be provided with extendible and retractable structures to extend the length of the handle. Handle 617 can be a rigid, one-piece structure attached to bottom wall 607 and supporting the housing 604.

Peg board, or walls having holes 631 and 632, are located adjacent opposite sides of drying chamber 608. Wall 631 is located inwardly from side wall 602 forming a passage 633 to allow air to flow from drying chamber 608 back to mixing chamber 621 in housing 604. Peg board 632 is located inwardly from side wall 603 forming a passage 634 to allow air to flow from drying chamber 608 into mixing chamber 621. The air in mixing chamber 621 is drawn by fan 624 back into drying chamber 608, thereby recirculating air from drying chamber 608 through mixing chamber 621 back into drying chamber 608. The recirculation of the air increases the moisture content of the air and improves the drying effectiveness and heat conservation efficiency. Part of the air in drying chamber 608 is recirculated back into mixing chamber 621. The remaining portion of the air is directed through filter 629 into the atmosphere, as indicated by arrows 633.

The detachable heat and fan unit in housing 604 is usable in association with a bag or equipment carrier. The equipment can be dried right in the carrier when the heat unit is attached thereto. The cover 609 can be a two-piece cover that opens in the middle to allow the dryer to be in an upright position for loading and unloading purposes.

While there has been shown and described preferred embodiments of the dryer of the invention, it is understood that changes in the structure and arrangement of structure can be made by those skilled in the art without departing from the invention. Changes in the locations, types and number of fans, heaters and ultraviolet and infrared lights and use of dehumidifiers in the dryers can be made by one skilled in the art which are equivalent to the claimed structure. The dryer can be vented to the outdoor environment with suitable ducts in lieu of exhaust filters. The invention is defined in the following claims.

I claim:

1. A dryer for articles comprising: housing means having an internal drying chamber for accommodating articles, door means movably mounted on the housing means for movement to an open position to permit access into the drying chamber and to a closed position to enclose the drying chamber, wall means within said housing means providing an air mixing chamber, said wall means having first and second openings to allow air to flow from the air mixing chamber into the drying chamber and out of the drying chamber into the air mixing chamber, heater means for heating air flowing into the drying chamber, first fan means located within the air mixing chamber operable to move air from the mixing chamber through said first opening into the drying chamber, second fan means located within the air mixing chamber operable to draw air from the drying chamber and discharge air mixing chamber, said housing means having at least one first opening communicating the air mixing chamber with the environment outside the dryer, damper means movable between open and closed positions relative to said first opening to selectively open and close said first opening to allow air to flow out of the air mixing chamber to the environment outside of the dryer and block the flow of air through said first opening, first control means responsive to the humidity of the air in the drying chamber for moving the damper means between the open and closed positions thereof, said second fan means operable to discharge air through the first opening to the environment outside of the dryer when the damper means is in the open position, first filter means mounted on the housing means covering said first opening to remove odors from the air flowing through said filter means, said housing means having at least one second opening into the drying chamber to allow outside air to flow into the drying chamber, second filter means extending across said second opening into the drying chamber to remove odors from the air flowing into the drying chamber, and second control means for the heater means and first and second fan means operable to connect the heater means and first and second fan means to a source of power whereby the first fan means moves air from the mixing chamber into the drying chamber, the heater means heats the air in the drying chamber, the heater means so that the air is heated and discharged as hot air into the drying chamber and the second fan means draws air from the drying chamber and air mixing chamber and discharges air to the environment outside of the dryer when the damper means is in the open position, said air in the drying chamber circulating and recirculating within the drying chamber to remove moisture from the articles within the drying chamber.

2. The dryer of claim 1 including: infrared light means within said drying chamber, and control means for connecting the infrared light means to a source of electric power whereby the infrared light means emits infrared light which heats the articles and the air within the drying chamber.

3. The dryer of claim 1 wherein: said housing means has a back wall with said second opening open to the drying chamber and the environment outside of the dryer to allow air to flow into the drying chamber.

4. The dryer of claim 1 including: bench means located within the drying chamber for accommodating at least one person.

5. The dryer of claim 4 including: means to pivotally attach the bench means to the housing means for movement between a generally horizontal position and an upright position.

6. The dryer of claim 1 including: drum means located within the drying chamber; means supporting the drum means for rotation about a generally horizontal axis, and means for rotating the drum means.

7. The dryer of claim 6 wherein: the drum means has a plurality of openings to allow air to flow through the drum means.

8. The dryer of claim 6 wherein: the means supporting the drum means comprise a plurality of rollers rotatably mounted on the housing means.

9. The dryer of claim 6 wherein: the means for rotating the drum means includes motor means mounted on the housing means, and means driveably connecting the motor means to the drum means.

10. The dryer of claim 1 wherein: the first control means includes a humidistat and means connected to the humidistat for moving the damper means between the open and closed positions thereof, said humidistat being operable when the moisture content of the air in the drying chamber is above a selected level to signal the means for moving the damper means to move the damper means to the open position whereby air in the mixing chamber is discharged to the environment outside of the dryer.

11. The dryer of claim 1 including: a boot dryer located within the drying chamber, said boot dryer having a casing accommodating an article, said tube means having a passage open to the internal chamber and the article, ultraviolet light means within the passage of the tube means adapted to emit ultraviolet light into the passage of the tube means and article on the tube means, and means for moving air through said chamber and tube means to dry the article retained on the tube means.

12. A dryer for articles comprising: housing means having an internal drying chamber for accommodating articles, means to permit access into the drying chamber to allow articles to be placed within the drying chamber, wall means within said housing providing an air mixing chamber, said wall means having at least one opening to allow air to flow from the air mixing chamber into the drying chamber and out of the drying chamber into the air mixing chamber, heater means for heating air in the drying chamber, first means operable to move air from the mixing chamber and into the drying chamber, second means operable to draw air from the drying chamber and selectively discharge air to the mixing chamber and the environment outside of the dryer, said housing means having a first opening open to the mixing chamber and the environment outside of the dryer and a second opening open to the drying chamber and the environment outside of the dryer, damper means movable between open and closed positions relative to said first opening to selectively open and close said first opening to allow air to flow out of the air mixing chamber to the environment outside the dryer and block the flow of air through said first opening, control means responsive to the moisture content of the air in the drying chamber for moving the damper means between the open and closed positions thereof from the environment outside of the dryer into the drying chamber.

13. The dryer of claim 12 including: bench means located within the drying chamber for accommodating at least one person.

14. The dryer of claim 13 including: means to pivotally attach the bench means to the housing means for movement between a generally horizontal position and an upright position.

15. The dryer of claim 12 including: drum means located within the drying chamber, means supporting the drum means for rotation about a generally horizontal axis, and means for rotating the drum means.

16. The dryer of claim 15 wherein: the drum means has a plurality of openings to allow air to flow through the drum means.

17. The dryer of claim 15 wherein: the means supporting the drum means comprises a plurality of rollers rotatably mounted on the housing means.

18. The dryer of claim 15 wherein: the means for rotating the drum means includes motor means mounted on the housing means, and means driveably connecting the motor means to the drum means.

19. The dryer of claim 12 wherein: the first control means includes a humidistat and means connected to the humidistat for moving the damper means between the open and closed positions thereof, said humidistat being operable when the moisture content of the air in the drying chamber is above a selected level to signal the means for moving the damper means to move the damper means to the open position whereby air in the mixing chamber is discharged to the environment outside of the dryer.

20. The dryer of claim 12 including: a boot dryer located within the drying chamber, said boot dryer having a casing with an internal chamber, tube means mounted on the casing means for accommodating an article, said tube means having a passage open to the internal chamber and the article, ultraviolet light means within the passage of the tube means adapted to emit ultraviolet light into the passage of the tube means and article of the tube means, and means for moving air through said chamber and tube means to dry the article retained on the tube means.

* * * * *